US005079580A

United States Patent [19]

Wada

[11] Patent Number: 5,079,580

[45] Date of Patent: Jan. 7, 1992

[54] APPARATUS FOR PROCESSING A SILVER HALIDE PHOTOGRAPHIC LIGHT-SENSITIVE MATERIAL

[75] Inventor: Yasunori Wada, Hino, Japan

[73] Assignee: Konica Corporation, Tokyo, Japan

[21] Appl. No.: 555,059

[22] Filed: Jul. 18, 1990

[30] Foreign Application Priority Data

Jul. 28, 1989 [JP] Japan ..... 1-195648

[51] Int. Cl.[5] ..... G03D 5/04

[52] U.S. Cl. ..... 354/299; 354/319; 354/325; 354/339

[58] Field of Search ..... 354/299, 317, 319, 324, 354/325, 339, 338

[56] References Cited

U.S. PATENT DOCUMENTS

| | | | |
|---|---|---|---|
| 3,608,464 | 9/1971 | Harrell | 354/317 |
| 3,662,660 | 5/1972 | Layne | 354/324 |
| 4,245,034 | 1/1981 | Libicky et al. | 354/324 |
| 4,577,948 | 3/1986 | Lawson et al. | 354/324 |
| 4,845,019 | 7/1989 | Vaughan | 354/325 |
| 4,931,378 | 6/1990 | Hirano et al. | 354/324 |
| 4,947,199 | 8/1990 | Tsunekawa | 354/324 |

FOREIGN PATENT DOCUMENTS

| | | |
|---|---|---|
| 50-144502 | 11/1975 | Japan . |
| 54-62004 | 5/1979 | Japan . |
| 55-115039 | 9/1980 | Japan . |
| 56-12645 | 2/1981 | Japan . |

*Primary Examiner*—A. A. Mathews

*Attorney, Agent, or Firm*—Frishauf, Holtz, Goodman & Woodward

[57] ABSTRACT

The invention provides an apparatus for processing a sheet-shaped halide photographic light-sensitive material having a hydrophilic colloidal layer on a substrate. In the apparatus, there are provided a plurality of guides for guiding the sheet-shaped material. Each of the plurality of guides has a slit for passing the sheet-shaped material through it, and the slit of the guide body is shaped to temporarily hold the developing solution by the work of surface tension of the solution. A heating device for heating the developing solution temporarily held by the slit is further provided. The sheet-shaped material is processed while passing through the slit during the temporary holding of the heated developing solution.

20 Claims, 3 Drawing Sheets

APPARATUS FOR PROCESSING A SILVER HALIDE PHOTOGRAPHIC LIGHT-SENSITIVE MATERIAL

BACKGROUND OF THE INVENTION

The present invention relates to an apparatus for the development processing of silver halide photographic light-sensitive material having a hydrophilic colloidal layer exposed to light.

A silver halide photographic light-sensitive material having hydrophilic colloidal layers is developed by an automatic developing apparatus, wherein, for example, a silver halide photographic light-sensitive material is conveyed with a roller conveyer into the developing bath in which sufficient amount of a developer is stocked, and is dipped for a predetermined time to be developed.

By developing this silver halide photographic light-sensitive material, effective components in the developer stocked in the developing bath is consumed. Therefore, the fatigue and the degradation of the developer occur by this exhaustion of the developer.

Also, in the case where the developer is an alkali, the developer is degraded by the fatigue caused by the oxidization by oxygen in air and/or by the neutralization reaction caused by absorption of $CO_2$ (Carbon dioxide) gas in the air as time passes.

Methods to recover such degradation of this developer, include replenishing a developing replenisher successively or intermittently according to the quantity of developing process, as is proposed in the specifications opened in Japanese Patent Publication Open to Public Inspection Nos. 144502/1975, 62004/1979, 115039/1980 and 12645/1981.

In order to prevent oxidization by air, a prior art apparatus develops the silver halide photographic light-sensitive material by passing it through a slit-type developing tank wherein the open-mouth area is reduced.

However, in the former type wherein a developer is replenished, the components of the new developing solution and those of the developing solution thereafter are different. Therefore, strictly speaking, it is inconvenient that the photographic processings having different properties are conducted in one apparatus, with the photographic characteristics after finishing becoming unstable.

In, the latter type, the developer receives an effect from the oxidization by air even though the open mouth area of the developing bath is reduced and as well, it becomes difficult to convey the silver halide photographic light-sensitive materials smoothly by because of the passing resistance when it passes the slit.

Against such difficulties, it has been considered to develop silver halide photographic light-sensitive material by supplying the developing solution on the exposed surface of the silver halide photographic light-sensitive material without dipping it into the developing solution stocked in the developing bath. However, in this case it is necessary to supply only a small quantity of the developing solution to the silver halide photographic light-sensitive material as well as to make the conveyance of the silver halide photographic light-sensitive material smooth.

Furthermore, in the case that the silver halide photographic light-sensitive material is processed by supplying a small quantity of the developing solution, the temperature of the developing solution can be easily changed according to the increment of supply, with the result being that the developing process becomes unstable.

SUMMARY OF THE INVENTION

The present invention was conducted considering the above-mentioned conditions. Its object is to supply a silver halide photographic light-sensitive material processing apparatus in which and an even stable developing process giving photographic characteristics at predetermined sensitive and graduations can be obtained.

In a silver halide photographic light-sensitive material processing apparatus wherein a developing solution containing hydroquinones is supplied on the exposed surface of a light-sensitive material having a hydrophilic colloidal layer on both sides of the substrate instead of the dipping of the photosensitive material into the developing solution, the light-sensitive material processing apparatus is characterized in having the above-mentioned developing solution, plural number of the guide means with slits which enable to convey the above-mentioned light-sensitive material through it and a heating means which keeps temperature of the developing solution at the slit part warm.

Between these guide means, a conveyance means which conveys the silver halide photographic light-sensitive material can be provided, and a washing means which supplies washing water to the slit of the guide means to wash can also be provided.

The silver halide photographic light-sensitive material is a high sensitive film such as X-ray film wherein hydrophilic colloidal layers are provided on the both sides of the substrate which is made of a transparent material. As this silver halide photographic light-sensitive material, the recipe opened in a Japanese Patent Publication Open to Public Inspection No. 23154/1988 is preferably used because it is excellent in sensitivity, fogging and graininess, and the scratch blackness and the sensitivity-reduction caused by the pressure is small regardless of the least gelatin content. The developing solution is supplied to both sides of the silver halide photographic light-sensitive material by conveying to the slit where the developing solution is preserved. This conveyance can be taken in a longitudinal direction and so it is a merit to be able to reduce the setting area of the apparatus.

Supplying of the developing solution to the silver halide photographic light-sensitive material is conducted, in this case, not by dipping the silver halide photographic light-sensitive material into the developing solution stocked. According to this type of supplying, a predetermined quantity of the developing solution which is necessary for the developing can be supplied so that the sequential exhaustion of the developing solution can be prevented and as well, the developing solution can be saved.

As hydroquinones used for the developing solution in the present invention, hydroquinone, chlorohydroquinone and methylhydroquinone can be used. Among them, hydroquinone is preferably used. The amount added is 1 to 20 grams per litter of the developing solution, and preferably 5 to 15 grams.

In the present invention, 3-pyrazolydone type developer, dialdehyde type hardener, antifoggant selected from imidazole type, benzimidazole type, benztriazole type and a mercaptothiazole type, chelate agent, buffer solution, alkali agent, dissolution-promoting agent, pH adjusting agent, development accelerator, surfactant and others can be further added to the developer according to necessity, as are disclosed in Japanese Patent Publication Open to the Public Inspection No. 10158/1988.

In the present invention, the silver halide photographic light-sensitive material is conveyed through the slit whereat the developing solution is preserved and the guide means plurally provided for conveyance-direction, where the developing solution of the predetermined temperature is supplied to the silver halide photographic light-sensitive material uniformly so that a stable developing process can be conducted resulting in developing evenness.

Besides, by the conveyance means provided between the guide means, the silver halide photographic light-sensitive material can be conveyed more smoothly.

Furthermore, the washing means supplies the washing water to the slit of the guide means, and the slit can be washed easily.

PREFERRED EMBODIMENT

Hereunder, embodiments of the present invention are explained in detail on the basis of the attached drawings.

Figure 1:
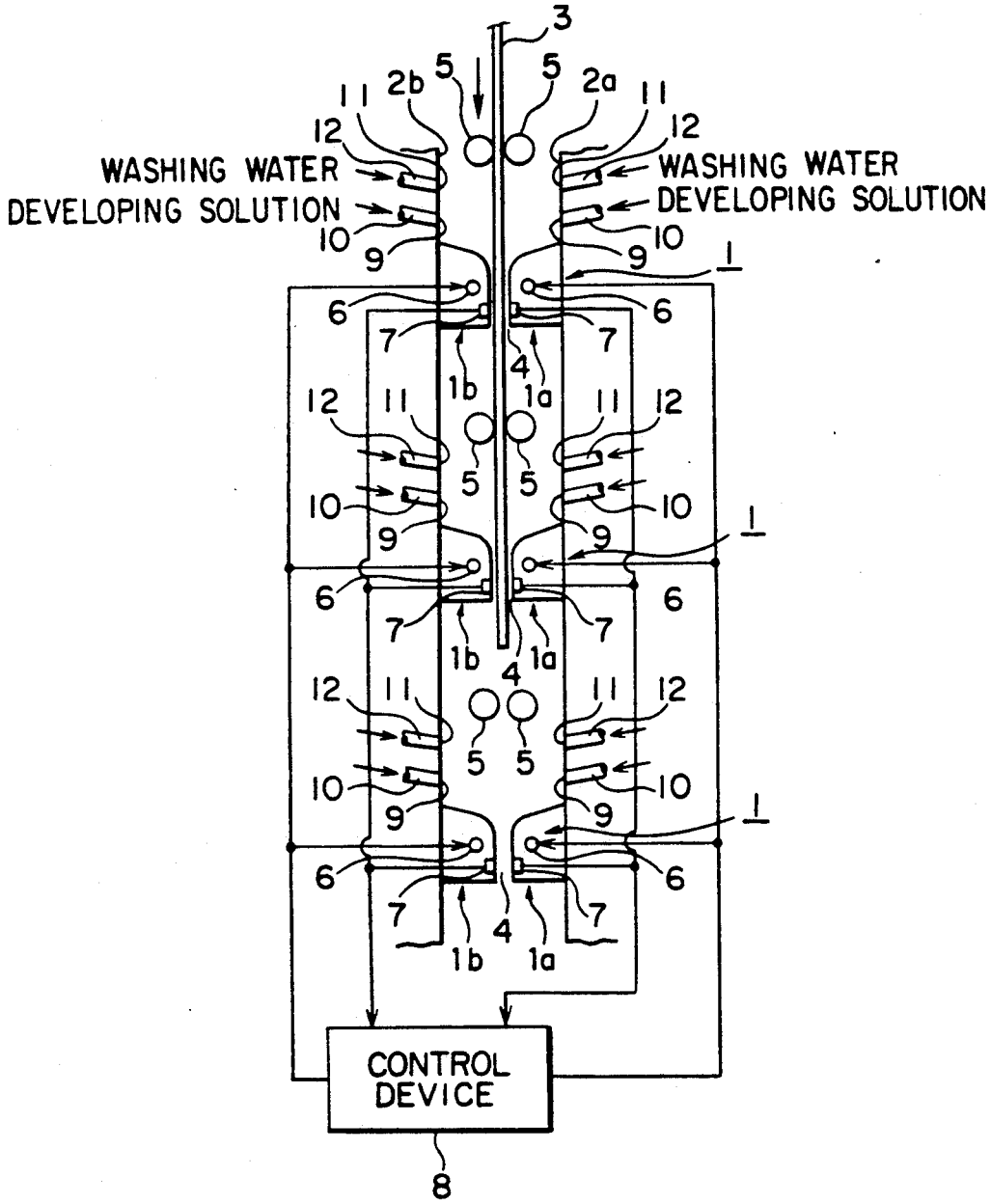
FIG. 1 is a general drawing of the light-sensitive material processing apparatus wherein a first embodiment of the present invention is applied.
Figure 2:
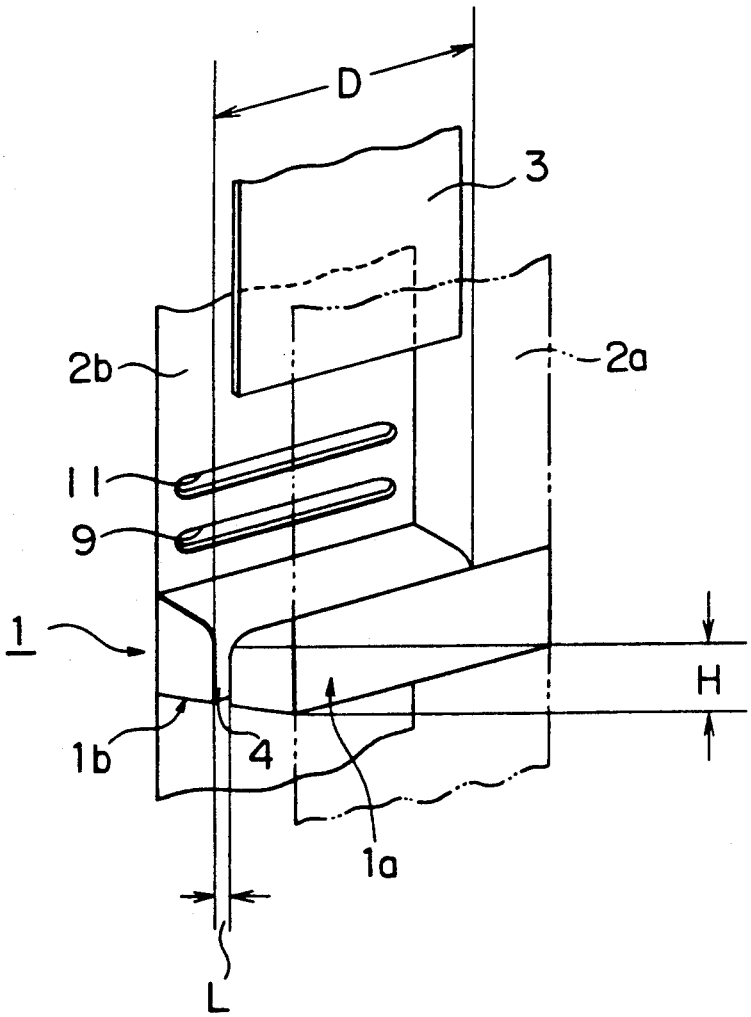
FIG. 2 is a perspective drawing of the guide means.

FIG. 1 is a general drawing of the light-sensitive material processing apparatus wherein the embodiment of the present invention is applied. FIG. 2 is a perspective drawing of the guide means.

In the drawings, numeral 1 is guide means which is composed of the guide body 1*a* and 1*b*. These guide means 1 are set plurally in a vertical direction and attached to the guide wall 2*a* and 2*b*. Between these guide bodies 1*a* and 1*b* of the guide means 1, the slits 4 are formed to which the silver halide photographic light-sensitive material 3 can be passed through thereat with the developer being preserved.

Between each of the guide means 1 in the perpendicular direction, a pair of the conveyance rollers 5 are provided, by which the silver halide photographic light-sensitive material 3 can be conveyed.

The width D of the slit 4 formed in the guide means 1 is formed a little wider than the silver halide photographic light-sensitive material 3 as shown in FIG. 2. The distance L of the slit 4 is so set that the silver halide photographic light-sensitive material 3 can be inserted and conveyed and so that the supplied developing solution can be preserved there by surface tension. Furthermore, the length H of the slit 4 in the conveyance direction is so set that an amount of the developing solution to be supplied to the silver halide photographic light-sensitive material 3 uniformly can be held.

Inside of the guide body 1*a* and 1*b* of the guide means 1, a heater 6 is provided as a heating means, by which the guide body 1*a* and 1*b* is heated so that the temperature of the developing solution preserved at the slit 4 can be kept constant. Besides, inside of the guide body 1*a* and 1*b*, the temperature sensor 7 is provided. The temperature information from it is conveyed to the control device 8 so that the temperature of the heater 6 can be adjusted.

Above the guide body 1*a* and 1*b* of the guide means 1, the slit 9 is formed on the guide wall 2*a* and 2*b*. This slit 9 is formed to the width direction of the silver halide photographic light-sensitive material 3. The supplying nozzle 10 is attached to this slit 9. Together, these components comprise the developing solution supplying means. The supplying nozzle 10 is so formed that the developing solution can be supplied uniformly in the width direction of the slit 9.

The developing solution is supplied from the supplying nozzle 10 through the slit 9 onto the guide body 1*a* and 1*b*. The developing solution flows on the guide body 1*a* and 1*b* to the slit 4, and it is held at the slit. Therefore, when the silver halide photographic light-sensitive material 3 is conveyed through the slit 4, the developing solution can be supplied uniformly to the exposed surface so that stable developing without unevenness can be achieved and that photographic characteristics of a predetermined sensitivity and a gradation can be obtained.

New developing solutions are supplied from each of the supplying nozzles 10, and the developer drops from the slit 4 of the top guide means to the second-guide means, then drops from the slit of the second-guide means to the third-guide means finally drops from the third-guide means to the lowest guide means. and is thereafter discarded. It means that the developing solution is used only once and then throws away.

Besides, this arrangement allows a tray to be provided under the lowest guide 1. By this means, the developing solution is dropped into a tray, and when a pipe is connected to the tray, the developer in the tray can be circulated to the supplying nozzle 10 by a pump. In this case, developing exhaustion does not occur in the developing solution, and as the developing solution circulated is little exposed to air, the sequential exhaustion caused by absorbed $CO_2$ gas is also small. Therefore, re-use is made possible.

At the upper part of the slits 9 which are the developing solution supplying means, slits 11 are similarly formed on the guide walls 2*a* and 2*b*. The supplying nozzles 12 are attached to these slits 11 as a washing means.

The developing process has been finished, the washing water is supplied to the supplying nozzle 12. This washing water flows on the slanting surface of 1*a* and 1*b* to the slit to wash the developing solution attached to the slanting surface and the slit 4. With the needed amount of washing water supplied, the developer is not held at the slit and dropped from the slit 4 to be drained.

Figure 3:
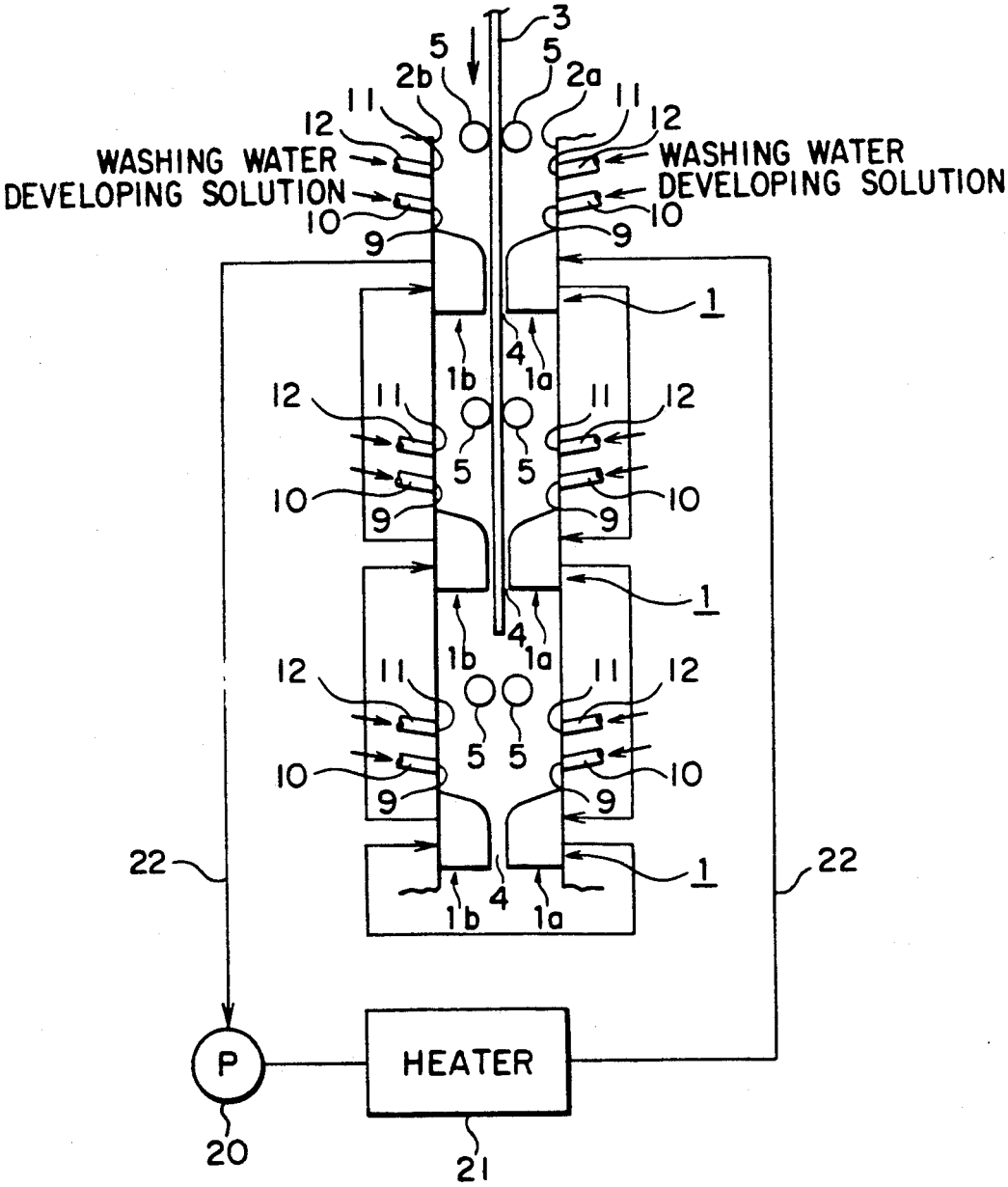
FIG. 3 is a general drawing of the light-sensitive material processing apparatus wherein another embodiments of the present invention are applied.

FIG. 3 shows an another embodiment. In this embodiment, members indicated by the same numerals as in the abovementioned embodiment are composed similarly, and explanation is omitted.

In this embodiment, the temperature of the developing solution preserved at the slit 4 of the guide means 1 is kept by hot water. The guide body 1*a* and 1*b* of the guide means 1 has liquid tight construction. By the driving of the pump 20, hot water heated by the heater 21 is supplied to the right side guide body 1*a* or the guide means 1 at the top through the pipe 22. This hot water circulates downward to the guide body 1*a* of the lower guide means 1 thereof, then moves to the left side guide body 1*b* from the guide body 1*a* of the bottom guide means 1. The hot water then circulates upward to the upper guide body 1*b*, and is finally returned to the pump 20 through the pipe 22.

In this embodiment, hot water is supplied to the top guide means 1 at one side of the guide body 1*a*, then circulated and taken out from the other side of the guide body 1*b*. However, the present invention is not limited to this method. It is be allowed that the hot water may supplied to the bottom guide means 1 at one side of the guide body 1*a* and taken out from the other guide body 1*b*. Furthermore, the hot water may be allowed to be supplied from the one of the guide body of the each guide means and taken out from the other guide body.

As explained above, in a light-sensitive material processing apparatus of the present invention, the developing solution is preserved at the plural number of the guides means having a slit through which a silver halide photographic light-sensitive material can be conveyed and a heating means for keeping the temperature of the developing solution at the slit constant is provided additionally. Owing to them, when a silver halide photographic light-sensitive material is conveyed through the slit, a stable developing process without developing unevenness can be conducted.

Besides, when the conveyance means conveying a silver halide photographic light-sensitive material is provided between the guide means, the silver halide photographic light-sensitive material can be conveyed more smoothly.

Furthermore, when a washing means is provided to the slit of the guide means, the slit of the guide means can be washed clean when the developing process is finished. Thus, washing can be conducted simply.

What is claimed is:

1. An apparatus for processing a sheet-shaped silver halide photographic light sensitive material comprising:
   - a plurality of guide means for guiding the sheet-shaped material, each of the plurality of guide means including a guide body having a slit for passing the guided sheet-shaped material therethrough;
   - feed means for feeding developing solution to the plurality of guide means;
   - the plurality of guide means being arranged vertically spaced apart to allow the developing solution fed by the feed means to drain downward from a slit of an upper guide body to a slit of a lower guide body; and
   - each guide body of the plurality of guide means being shaped so that its slit temporarily holds the developing solution therein and that the sheet-shaped material is processed while passing through the slit of each guide body by the temporarily held developing solution.

2. The apparatus of claim 1, further comprising means for cleaning the slit of each guide body by supplying washing water to the slit of each guide body.

3. The apparatus of claim 1, wherein the plurality of guide means are vertically disposed in tandem to pass the sheet-shaped material vertically through the slit of each guide body.

4. The apparatus of claim 1, wherein each guide body is shaped so that its slit temporarily holds the developing solution by means of surface tension in the developing solution.

5. The apparatus of claim 4, wherein each guide body is shaped so that its slit drains the developing solution after it is temporarily held.

6. The apparatus of claim 1, further comprising means for conveying the sheet-shaped material through the plurality of guide means.

7. The apparatus of claim 6, wherein said conveying means includes means for conveying said sheet-shaped material downwardly in a substantially vertical direction through said plurality of guide means.

8. The apparatus of claim 1, wherein said silver halide photographic light sensitive material has a hydrophilic colloidal layer on a substrate.

9. The apparatus of claim 8, wherein said developing solution contains hydroquinones.

10. The apparatus of claim 1, further comprising heating means for heating the developing solution temporarily held by the slit of each of said guide bodies.

11. The apparatus of claim 10, wherein said developing solution contains hydroquinones.

12. An apparatus for processing a sheet-shaped silver halide photographic light sensitive material comprising:
   - a plurality of guide means for guiding the sheet-shaped material, each of the plurality of guide means including a guide body having a slit for passing the sheet-shaped material therethrough;
   - feed means for feeding developing solution to the plurality of guide means;
   - the slit of each guide body being shaped to temporarily hold the developing solution fed by the feed means so as to process the sheet-shaped material;
   - heating means for heating the developing solution temporarily held by the slit of each guide body; and
   - cleaning means for cleaning the slit of each guide body by supplying washing water to the slit of each guide body.

13. The apparatus of claim 12, further comprising means for conveying the sheet-shaped material through the plurality of guide means.

14. The apparatus of claim 12, wherein the plurality of guide means are vertically disposed in tandem to pass the sheet-shaped material vertically through the slit of each guide body.

15. The apparatus of claim 12, wherein the slit of each guide body is shaped to temporarily hold the developing solution by means of surface tension in the solution.

16. The apparatus of claim 13, wherein said conveying means includes means for conveying said sheet-shaped material downwardly in a substantially vertical direction through said plurality of guide means.

17. The apparatus of claim 16, wherein the guide means are arranged vertically spaced apart to allow the developing solution to drain downward from a slit of an upper guide body to a slit of a lower guide body.

18. The apparatus of claim 1, wherein the guide means are arranged vertically spaced apart to allow the developing solution to drain downward from a slit of an upper guide body to a slit of a lower guide body.

19. The apparatus of claim 1, wherein said silver halide photographic light sensitive material has a hydrophilic colloidal layer on a substrate.

20. The apparatus of claim 1, wherein said developing solution contains hydroquinones.

* * * * *